US006113416A

United States Patent [19]

Holzer

[11] Patent Number: 6,113,416

[45] Date of Patent: Sep. 5, 2000

[54] METHOD AND DEVICE FOR LOCKING OF ELECTRICAL PLUG-IN CONNECTIONS FOR LAMPS

[76] Inventor: Walter Holzer, Drosteweg 19, D-88709 Meersburg, Germany

[21] Appl. No.: 09/007,568

[22] Filed: Jan. 15, 1998

[30] Foreign Application Priority Data

Jun. 3, 1997 [DE] Germany ..... 197 23 029

[51] Int. Cl.[7] ..... H01R 13/627

[52] U.S. Cl. ..... 439/357

[58] Field of Search ..... 439/152, 357, 439/374, 375, 376

[56] References Cited

U.S. PATENT DOCUMENTS 4,883,434 11/1989 Toyoshima ..... 439/619
5,008,588 4/1991 Nakahara ..... 313/318
5,334,041 8/1994 Anbo et al. ..... 439/358
5,752,842 5/1998 Friederichs et al. ..... 439/152

*Primary Examiner*—Khiem Nguyen
*Assistant Examiner*—Brian S. Webb
*Attorney, Agent, or Firm*—Marshall, O'Toole, Gerstein, Murray & Borun

[57] ABSTRACT

The invention concerns a new improved alternative to the previous Edison sockets and the so-called bayonet sockets which are used to mount electric lights. A lamp base and socket are provided which have cooperating profiled surfaces which serve to guide the lamp base into its proper position in the socket and to lock the base into position. Supporting surfaces are provided on the lamp base and lamp socket which form a pivot for releasing the lamp from the socket.

Despite high locking forces, a tilting movement of the lamp and the lever translation produced by moving these surfaces permits easy release of the lamp from the socket.

2 Claims, 1 Drawing Sheet

METHOD AND DEVICE FOR LOCKING OF ELECTRICAL PLUG-IN CONNECTIONS FOR LAMPS

BACKGROUND OF THE INVENTION

Ideally, electrical connections for removable or plug-in electrical components should be both reliable and easy to make, i.e., the component should be simple to connect and to separate from an electrical power source. This is particularly true of electrically-powered lamps and is one of the reasons that the Edison screw socket and the so-called bayonet socket have been widely tolerated for many decades despite obvious shortcomings.

Simple screwing-in and unscrewing have been the routine procedures for connecting and disconnecting such devices (e.g., the Edison socket). Even the more complicated process used to mount and dismount components having bayonet sockets, in which an axial pressure must first be exerted in order to be able to release a lamp from its socket with a short rotary movement, has become accepted because of better vibration safety.

The problem with the design of these sockets is that the electrical contacts in such sockets present a potentially life-threatening shock hazzard if incidentally touched during insertion and removal of electrical lamps. Notwithstanding these inherent defects, these socket designs have been tolerated worldwide by responsible regulating agencies.

Thus, there is the need for a new lamp base and socket system with improved safety characteristics which is capable of meeting established requirements of international testing and regulating authorities (e.g., Underwriters Laboratories in the United States). Designs of such lamp base and socket systems which incorporate plug pins on the base of the lamps have been described in my co-pending U.S. patent applications Ser. No. 08/831,903, filed Apr. 2, 1997, and Ser. No. 08/985,348 filed Dec. 4, 1997, the disclosures of which are incorporated herein. As described in the above-referenced documents, pins on the base of electric lamps mate with recesses or holes in the base of electrical sockets. Both the base of the lamps and the interior of the sockets can be profiled with sloping surfaces and detents in order to guide the lamp pins into the proper position and to firmly secure the lamps within the lamp socket.

SUMMARY OF THE INVENTION

The task of the present invention is to further implement the design of such plug-in connections by maintaining the locking connection between the lamp and socket, while improving the ease of inserting and removing the lamp from the socket.

This is achieved according to the invention in that separation of an electrical lamp from its plug-in connection is accomplished by a tilting movement of the lamp from the center line.

This can occur by providing supports both on the lamp base and on the lamp socket apart from the regions that define the electrical contacts and the profiled lamp-locking system. When the lamp is in its fully-seated position, the lamp base support and the lamp socket support are in physical contact. However, a slight tilting movement of the lamp or lamp base from the center line, converts this movement as an angular lever into an axial separation movement so that the locking profiles joining the lamp and socket are at least partially disengaged.

It is then possible to design lamp-socket systems which incorporate locking forces having sufficient strength so that even heavy energy-saving lamps with integrated switching devices can be reliably secured in a socket; but, because of the lever action, even a limited force is sufficient to remove the seated lamp from the socket.

Said supports can be arranged advantageously around the axis of the lamp-socket connection so that the tilting movement in any desired direction leads to shifting of the locking profile and at least partially disengages it.

The schematic depictions of a practical example in FIGS. 1 to 4 serve for better understanding of the idea of the invention. The drawings are not to be interpreted as limiting, but merely as one of the numerous possibilities for implementing the idea according to the invention.

DETAILED DESCRIPTION OF THE PREFERRED EMBODIMENT

As an example, a round plug-in connection was chosen, which can be used as a lamp socket for everyday lamps and for energy-saving lamps. In all figures the corresponding parts are provided with the same reference numbers.

Figure 1:
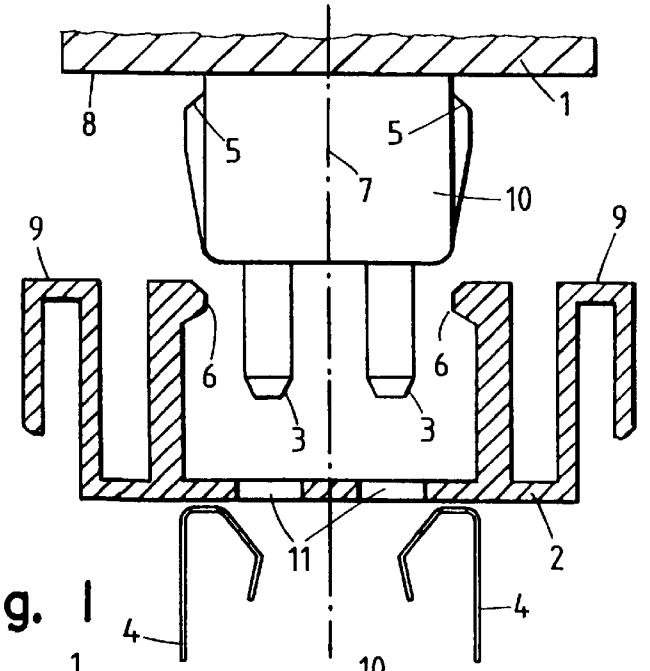
FIG. 1 is a sectional view depicting a plug-in connection for joining a lamp base with a socket in accordance with the present invention.

The two plug contacts (3) and the rigid locking profile (5) are arranged in FIG. 1 on the base (1) with its base body (10).

Figure 2:
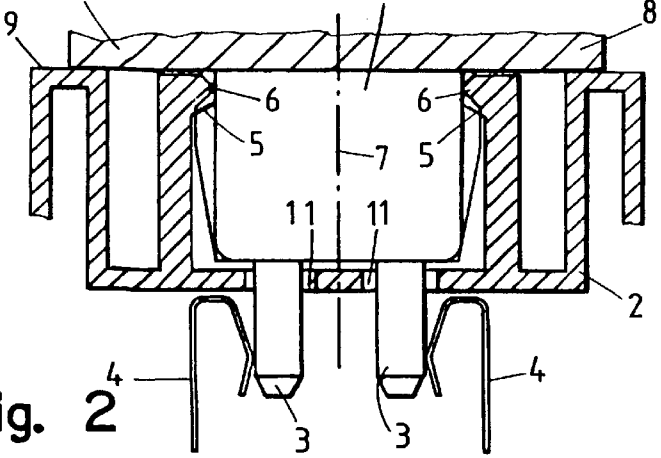
FIG. 2 represents the same plug-in connection after joining of the base and socket.

The corresponding socket (2) is shown in cross-section and the two spring-loaded locking profiles (6) are apparent, which can be designed directly as molded-on parts of the base (2) made of plastic. The high quality and shape stability of fiberglass-reinforced plastics is particularly suitable for this type of design. The two schematically depicted spring-loaded counter contacts (4) of socket (2) produce good contact with the plug pins (3) when the base (1) is inserted, as shown in FIG. 2. The locking function between the rigid locking profiles (5) and the spring-loaded locking profiles (6) is also clearly apparent in FIG. 2.

When the base (1) is plugged in, the supports (8) of the base, which are designed as a round plate, lie directly on the support surfaces (9) of the socket, which can also be designed as a circular annular surface. If expedient, a number of point-like supports can also be provided or, instead of a circular surface, the support can be given an oval or any other desired shape in order to achieve different lever translations of the tilting movement in different directions.

Figure 3:
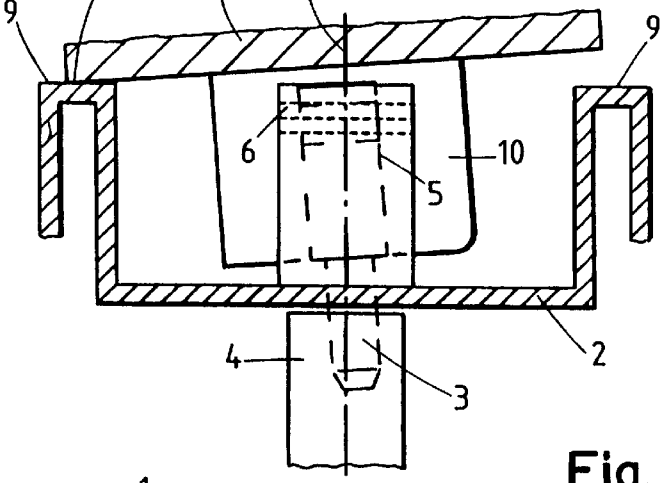
FIG. 3 shows the same plug-in connection rotated 90° around the axis after a slight tilting movement of the base.

The actual function of the tilting movement is clearly apparent in FIG. 3. This depiction is also shown as a cross section, but rotated by 90° around center line (7).

After tilting of base (1) the support (8) of base (1) lies on the support (9) of socket (2) designed as an annular surface and the locking profiles (5) and (6) are shifted in the longitudinal direction of center line (7).

Figure 4:
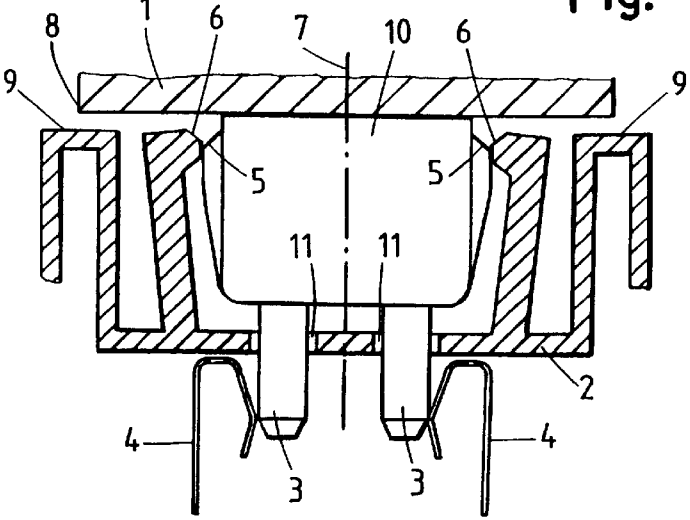
FIG. 4 shows the same plug-in connection as in FIGS. 1 and 2, but after the tilting movement is completed.

This shift is again shown in FIG. 4 in a view corresponding to FIGS. 1 and 2. The rigid locking profiles (5) have forced the spring-loaded locking profiles (6) sideways so that only the friction closure between the locking surfaces must be overcome during separation of the base (1) from socket (2).

It goes without saying that sufficient play must be present between base (1) and base body (10) and socket (2) in order to permit a tilting movement. A special counter support for the tilting movement is not necessary in principle, but could be provided, for example, by supporting the plug pins (3) in holes (11) of socket (2). Support between the spring-loaded counter contacts (4) would also be possible in order to define the tilting movement.

The advantages of the new method are obvious. It eliminates troublesome screwing-in and unscrewing, which is not only time consuming, but requires holding of the lamp socket, which is not at all simple, especially in suspended lights. Reliable locking of the lamp in the socket with high forces and easy "tilting out" of the lamp characterize the new method.

What is claimed is:

1. A lamp base and socket system for electrically powered lights comprising:

a lamp base having plug pins extending therefrom;

a rigid locking profile on said lamp base;

a first supporting surface on said lamp base;

a lamp socket containing recessed contacts for mating with said lamp base plug pins;

a spring-loaded locking profile on said lamp socket, said spring-loaded locking profile adapted to cooperate with the rigid lamp base locking profile when the lamp base and socket are fully connected; and a second supporting surface on said lamp socket for contacting the first supporting surface of said lamp base when said lamp and socket are fully connected, said first supporting surface and second supporting surface defining a pivot, whereby application of a tilting force to said lamp base when it is mounted in said lamp socket releases said lamp locking profile from contact with said socket locking profile, allowing said lamp base to be removed from said socket.

2. The apparatus of claim 1 wherein said lamp base has a circular cross section, and wherein said lamp socket comprises a circular annular surface.

* * * * *